US005181875A

United States Patent [19]

Hasegawa

[11] Patent Number: 5,181,875

[45] Date of Patent: Jan. 26, 1993

[54] BUBBLE-FORMING TOY SWORD

[76] Inventor: Gary K. Hasegawa, 1457 W. Hutchinson, Chicago, Ill. 60613

[21] Appl. No.: 848,029

[22] Filed: Mar. 9, 1992

[51] Int. Cl.[5] ..... A63H 33/28; A63H 3/00; A63H 33/30

[52] U.S. Cl. ..... 446/15; 446/74; 446/473

[58] Field of Search ..... 446/15, 16, 17, 18, 446/19, 20, 48, 69, 71, 74, 76, 473, 475

[56] References Cited

U.S. PATENT DOCUMENTS

| | | | |
|---|---|---|---|
| 2,560,582 | 7/1951 | Limber | 446/18 |
| 2,828,579 | 4/1958 | Schwerbell et al. | 446/19 |
| 2,942,374 | 6/1960 | Mann | 446/15 |
| 3,399,485 | 9/1968 | Cashavelly et al. | 446/15 |
| 3,952,923 | 12/1975 | LaFata et al. | 446/18 |
| 4,184,284 | 1/1980 | Rogahn | 446/48 X |
| 4,334,383 | 6/1982 | Melotti | 446/473 X |
| 5,041,042 | 8/1991 | Stein | 446/48 X |

FOREIGN PATENT DOCUMENTS

| | | | |
|---|---|---|---|
| 829062 | 2/1960 | United Kingdom | 446/473 |
| 2199256 | 7/1988 | United Kingdom | 446/473 |

*Primary Examiner*—Neal Muir

*Attorney, Agent, or Firm*—John J. Kowalik; Francis C. Kowalik

[57] ABSTRACT

A bubble-making device in the shape of a sword having a blade with holes therein, the sword being made of flexible plastic, and the holes having a toothed periphery, the blade being bendable to an extent to cause the bubble-forming solution to peel off the blade as the blade is caused to vibrate.

11 Claims, 2 Drawing Sheets

BUBBLE-FORMING TOY SWORD

BACKGROUND OF THE INVENTION

This invention relates to the bubble-forming art in which a rigid elongated element is used to provide a swingable stick or bat with holes therethrough which is adapted to be dipped into a bubble-forming solution and then swished about to cause air to push through the holes thereby forming bubbles from a film which bridges the holes.

DISCUSSION OF THE PRIOR ART

The provision of apertures in rigid bats is known. The way that the solution spreads over the holes in such rigid bat obtains a minimal quantity of bubbles since most of the surfaces on such bat will cause the solution to migrate into areas between the holes as the bat is swung from side to side to pass air through the holes. The shape of the bat is invariably cylindrical and therefore the solution which is applied to the bat by dipping it into a reservoir is not contained on the bat but will be slung off the surface by centrifugal force without entering any of the bubble-forming holes. The rigidity of the bat or wand and its cylindrical shape prevents trapping residual amounts of the solution for delivery during several swipes of the bat. Thus, a large quantity of the solution is wasted and the bat must be dipped quite frequently into the solution.

In addition, the rigid bat does not facilitate peeling the film off the surface of the bat in a manner to effectively deliver the film to the bubble-forming holes.

SUMMARY OF THE INVENTION

This invention has for its object the provision of a flexible sword-shaped device with flat surfaces on its opposite sides which maximizes the area which is coated during each dip of the blade of the sword into the solution.

A further object is to arrange the holes in the blade between the tip of the blade and an intermediate section of the blade and to provide reservoirs in the hilt end of the blade so arranged that during swishing of the blade the solution in the reservoirs will be caused to migrate into the bubble-forming holes.

These and other objects inherent in and encompassed by the invention will become apparent from the specification and the drawings, wherein.

Figure 6:
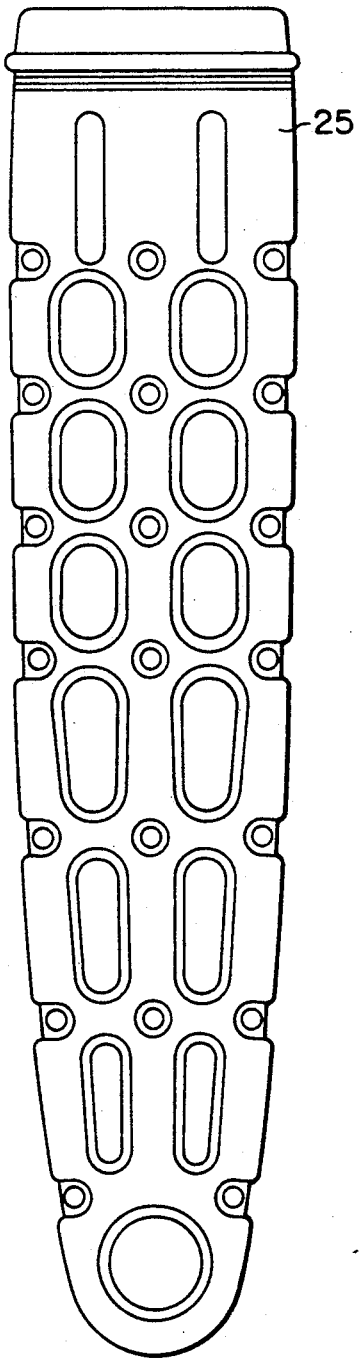
FIGS. 6-9 illustrate the scabbard.
Figure 7:
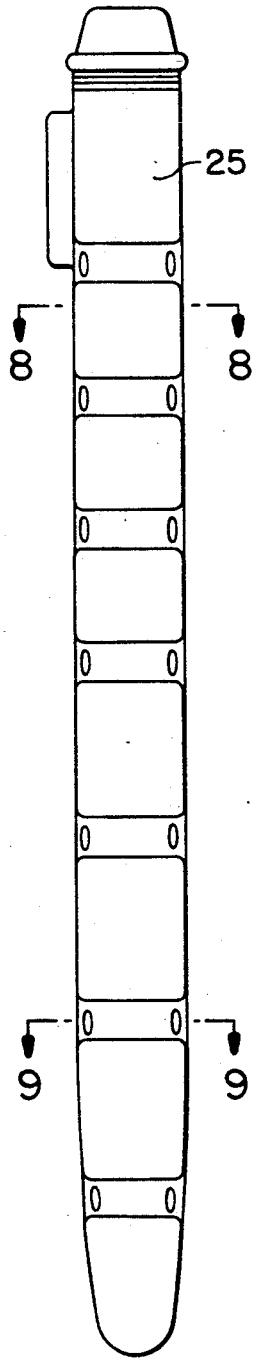
Figure 8:
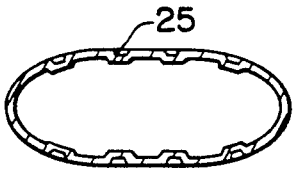
Figure 9:
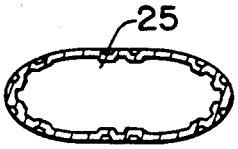

FIG. 6 being a side view;

FIG. 7 being an edge view;

FIG. 8 being a cross-section taken essentially on line 8—8 of FIG. 6, and FIG. 9 being a cross-section on line 9—9 of FIG. 6.

DESCRIPTION OF THE INVENTION

Referring to the drawings, the sword generally designated 2 is made of flexible plastic such as polyethylene and comprises a handle portion 4 and a blade 6 extending from the hilt 7.

The blade is generally flat and has its inner or hilt end portion 8 formed at its distal end with a shank 10 having integral securing rings 12 which fit into complementary grooves in the handle 16.

The handle has a hand-grasp portion 18 and is formed of two halves 20,20 which are bonded together as shown.

It will be noted that the inner end portion of the blade is formed with a transverse rib 22 which at its opposite ends merges with the adjacent ends of the peripheral ribs 24,24. The ribs 24,24 are integrally formed with the lateral edges of the flat panel section 28 which forms a trough 30 for holding the solution as the blade is withdrawn from the scabbard 25.

Figure 1:
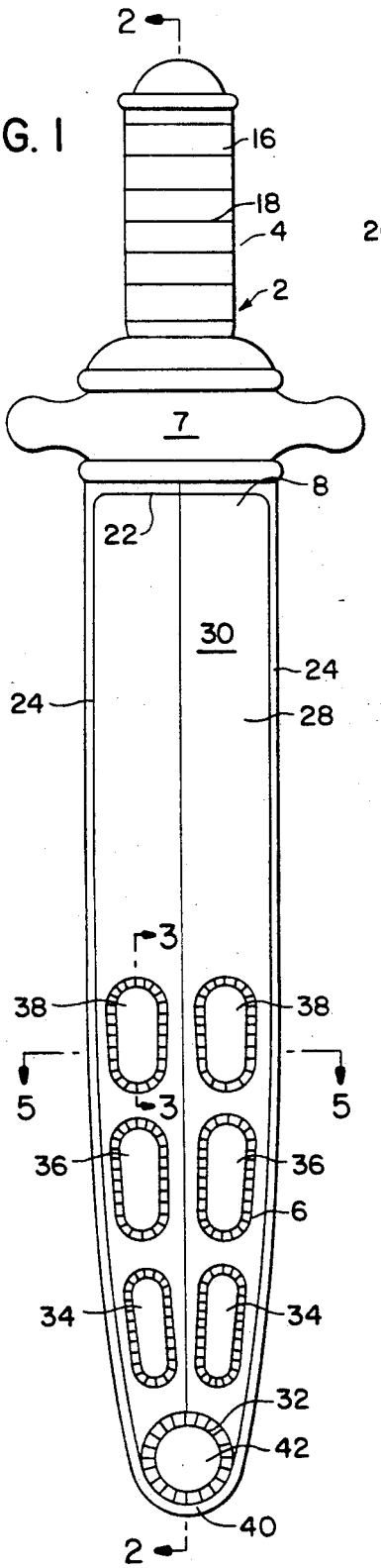
FIG. 1 is a side elevation of the novel sword.
Figure 2:
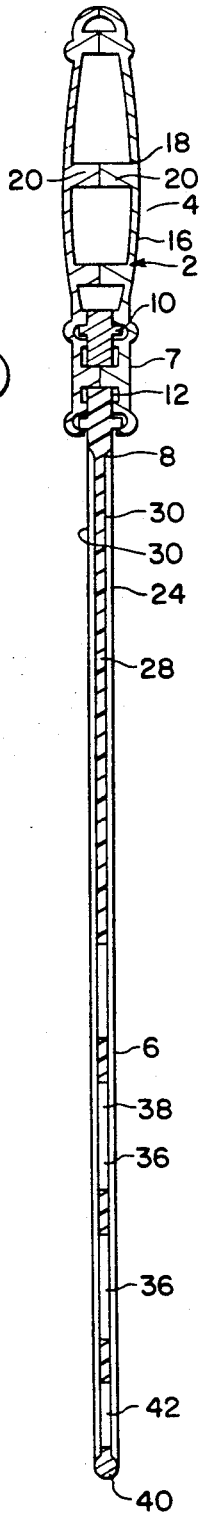
FIG. 2 is a longitudinal axial sectional view of said sword taken essentially on line 2—2 of FIG. 1.
Figure 5:
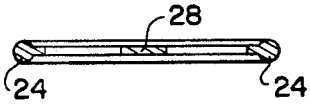
FIG. 5 is a sectional edge view of the blade in bent position.
Figure 4:
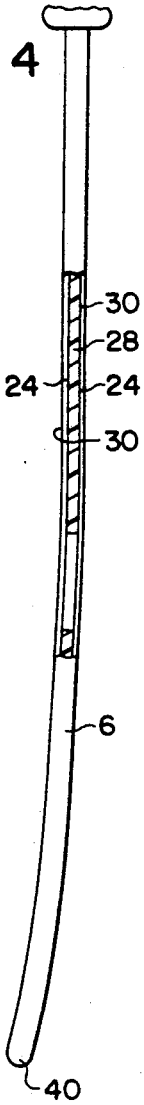
FIG. 4 is a cross-section on line 4—4 of FIG. 1.
Figure 3:
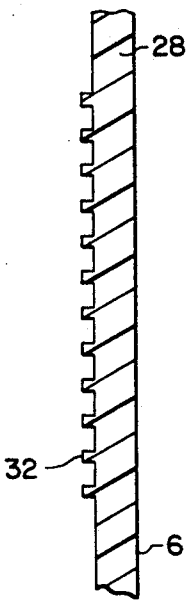
FIG. 3 is an enlarged cross-section of the blade through one of the holes thereof taken substantially on line 3—3 of FIG. 1.

The blade of the sword fits complementally into the scabbard which is deep enough to hold an amount of solution sufficient to coat the entire blade. The tip end 40 of the blade is provided with a circular hole 42 with comb-like teeth 32. The blade comprises a series of pairs of oblong holes 34,36,38 which are disposed between the end of the blade and its intermediate section. The holes 38,38 are placed side by side as are the holes 34,34 and 36,36. The oblong holes are also equipped with comb-like teeth 32 which, in addition to holding an enhanced amount of fluid, also serve to channel the flow of bubble fluid from the proximal trough 30 to the tip 40. Also as seen in FIGS. 1 and 3 toothed ablong holes 34,34; 36,36; and 38,38 serve to stiffen the distal holed section of the blade so as to maximize the transverse deflection in the unreinforced trough area 30 and thereby maximizing transverse acceleration at the tip 40. It will be seen that the blade is flexible transversely as shown in the drawings. Thus as the blade is swung from side to side, in a longitudinal plane perpendicular to the plane containing the width of the blade vibrations are set up in the blade which causes the solution to migrate along the top and bottom troughs of the of the blade from its unperforated inner end section to the outer end section and into the holes formed therein.

I claim:

1. A bubble-making device comprising a sword-shaped member including a flat blade portion having a peripheral rib, a proximal unreinforced trough section, and a distal holed section with a plurality of bubble forming holes therethrough, said blade portion being transversely flexible and by means of said trough section being unreinforced adapted to vibrate to facilitate release of bubble-forming film applied to the blade-shaped member being swished about transverse to said blade portion.

2. The invention according to claim 1 and a sheath providing a reservoir for holding the bubble-forming fluid for coating the blade portion upon sheathing thereof.

3. The invention according to claim 2 and said bubble-forming holes having toothed edges for enhancing the creation of bubbles as air is passed through the bubble-forming holes by vibrations induced by swinging of the sword-shaped member.

4. The invention according to claim 3 and said blade portion having a flat center section, and a peripheral rib thereabout forming a pan-like depression adapted to hold a residue of said bubble-forming solution in a position to direct said residue into the holes attendant to swishing of the sword-shaped member.

5. A sword-shaped bubble-forming device comprising a handle at one end a blade projecting therefrom, said blade having an inner end portion, means connecting the inner end portion with the handle, said blade having an outwardly tapered outer end portion terminating in a tip section with bubble-forming holes, said blade being transversely flexible between said portions and operative to release bubble-forming solution applied thereto over the holes in the blade.

6. The invention according to claim 5 and said holes being grouped adjacent to the tip of said outer end portion and defining a centrifugal flow path for said bubble-forming solution, said flow path terminating in an area encompassing said holes as centrifugal force is being applied thereto resulting from swinging of the blade.

7. A bubble-making device comprising a flexible sword-like flat blade with a plurality of bubble-forming holes at one end, said blade adapted to be plunged into a bubble-forming solution, and said blade further comprising a peripheral rib operative to constrain said bubble-forming solution so it may be centrifugally propelled toward said bubble-forming holes upon said blade being swung and toothed edge means for facilitating release of the solution from the blade as bubbles.

8. The invention according to claim 7 and said holes arranged interior to said rib and forming channels therewith to guide the centrifugal propulsion of said fluid to said holes.

9. The invention according to claim 7 wherein said blade is comprised of a flexible plastic.

10. The invention according to claim 8 wherein said holes are elongated lengthwise of the blade.

11. The invention according to claim 9 wherein said flexible plastic in polyethylene.

* * * * *